US009385407B2

(12) United States Patent
Kawamura et al.

(10) Patent No.: US 9,385,407 B2
(45) Date of Patent: Jul. 5, 2016

(54) RADIO-WAVE HALF MIRROR FOR MILLIMETER WAVEBAND AND METHOD OF SMOOTHING TRANSMITTANCE

(71) Applicant: ANRITSU CORPORATION, Kanagawa (JP)

(72) Inventors: Takashi Kawamura, Kanagawa (JP); Akihito Otani, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 481 days.

(21) Appl. No.: 13/685,894

(22) Filed: Nov. 27, 2012

(65) Prior Publication Data

US 2013/0135062 A1 May 30, 2013

(30) Foreign Application Priority Data

Nov. 30, 2011 (JP) ..... 2011-262521

(51) Int. Cl.

| | |
|---|---|
| ***H01P 1/08*** | (2006.01) |
| ***H01P 1/207*** | (2006.01) |
| ***H01P 1/20*** | (2006.01) |
| ***H01P 7/06*** | (2006.01) |
| *H01P 1/208* | (2006.01) |

(52) U.S. Cl.

CPC ..... *H01P 1/2002* (2013.01); *H01P 7/06* (2013.01); *H01P 1/08* (2013.01); *H01P 1/2084* (2013.01)

(58) Field of Classification Search

CPC ..... H01P 1/2084; H01P 3/12; H01P 1/08

USPC ..... 333/208, 209, 252

See application file for complete search history.

(56) References Cited

U.S. PATENT DOCUMENTS

| | | | | |
|---|---|---|---|---|
| 3,387,237 | A * | 6/1968 | Cook | 333/252 |
| 3,675,165 | A * | 7/1972 | Ueda et al. | 333/252 |
| 2005/0237134 | A1 * | 10/2005 | Furuya | H01P 1/20 333/202 |

OTHER PUBLICATIONS

Teshirogi, et al., "Modern Millimeter-Wave Technologies", Wave Summit Course, 2001.

* cited by examiner

*Primary Examiner* — Robert Pascal
*Assistant Examiner* — Gerald Stevens
(74) *Attorney, Agent, or Firm* — Pearne & Gordon LLP

(57) ABSTRACT

A radio-wave half mirror for millimeter waveband is fixed inside a transmission line propagating electromagnetic waves of millimeter waveband in a single mode so as to transmit a part of incident electromagnetic waves and reflect a part thereof. The radio-wave half mirror includes: a half mirror body where a slit for transmitting electromagnetic waves is provided on a metal plate; and a dielectric plate that is provided on one surface side of the half mirror body so as to form a dielectric resonator which resonates at a frequency determined by the thickness and the permittivity, and has a transmittance characteristic having a degree of inclination substantially the same as that of the half mirror body in a slope which is inverse to a slope of a transmittance characteristic of the half mirror body in a desired frequency range of the millimeter waveband.

18 Claims, 6 Drawing Sheets

RADIO-WAVE HALF MIRROR FOR MILLIMETER WAVEBAND AND METHOD OF SMOOTHING TRANSMITTANCE

TECHNICAL FIELD

The present invention relates to a radio-wave half mirror fixed in a waveguide for millimeter waveband, and a technology for smoothing the frequency characteristics of the transmittance of electromagnetic waves which are propagated through the transmission line formed by the waveguide.

BACKGROUND ART

Recently, as a ubiquitous network society has been realized, there has been an increase in the demand to use radio waves. In this situation, the use of millimeter waveband wireless systems such as a WPAN (wireless personal area network) has begun, which achieve wireless broadband in the home, and a millimeter wave radar which supports safe and comfortable driving. Further, efforts are being made to achieve a wireless system used at a frequency of 100 GHz or more.

Meanwhile, regarding evaluation of a second-order harmonic of a wireless system of a band of 60 GHz to 70 GHz or evaluation of a wireless signal in a frequency band of more than 100 GHz, as the frequency increases, the conversion loss of the mixer and the noise level of the measuring instrument increase, and the frequency accuracy decreases. For this reason, a technique for high-sensitivity and high-accuracy measurement of the wireless signal of more than 100 GHz has not been established. Furthermore, in the existing measurement techniques, the locally-generated harmonics cannot be separated from the measurement result, and it is difficult to perform precise measurement of undesired emission and the like.

In order to solve such a technical problem, it is necessary to achieve high-sensitivity and high-accuracy measurement of a wireless signal using a wideband of 100 GHz or more. Hence, it is necessary to develop techniques for various circuits including a narrowband filter for the millimeter waveband for inhibiting image responses and high-order harmonic responses.

For example, as the filter used as a variable-frequency type in the millimeter waveband, (a) a filter which uses a YIG resonator, (b) a filter in which a varactor diode is added to a resonator, and (c) a Fabry-Perot resonator have been known.

As the filter which uses the YIG resonator in (a), there is a known filter which can be used in a range up to about 80 GHz in a present situation. In addition, as the filter in which the varactor diode is added to the resonator in (b), there is a known filter which can be used in a range up to about 40 GHz. However, it is difficult to manufacture a filter which can be used at a frequency more than 100 GHz.

In contrast, the Fabry-Perot resonator in (c) has been widely used in the optical field, and a technique for using the resonator for millimeter waves is disclosed in Non-Patent Document 1. Non-Patent Document 1 discloses a confocal Fabry-Perot resonator which achieves high Q by having a pair of spherical reflective mirrors reflecting the millimeter waves opposite each other with a space equal to the radius of curvature thereof.

RELATED ART DOCUMENT

Non-Patent Document

[Non-Patent Document 1] "Modern Millimeter Wave Technologies" Tasuku Teshirogi and Tsukasa Yoneyama, Ohmsha, 1993, p 71

DISCLOSURE OF THE INVENTION

Problem that the Invention is to Solve

However, in the confocal Fabry-Perot resonator, in a case of changing a distance between mirror surfaces in order to tune a passband, the focus thereof is, in principle out of focus, and thus it can be expected that Q drastically decreases. Consequently, the pair of reflective mirrors, of which the curvature is different, has to be selectively used for each frequency.

Meanwhile, there is a Fabry-Perot resonator widely used in the optical field, which is a resonator having a structure in which planar half mirrors are disposed opposite each other. In this structure, in principle Q does not decrease even when the distance between the mirror surfaces is changed. However, in order to achieve the filter using the plane-type Fabry-Perot resonator in the millimeter waveband, there are the following further problems to be solved.

(A) It is necessary that plane waves are incident in parallel on the half mirrors. In a case where the input to the filter is through the waveguide, it is contemplated that the plane waves are achieved by increasing the diameter thereof like that of the horn antenna, but the size thereof increases. Even in this case, it is difficult to achieve perfect plane waves, and characteristics thereof deteriorate.

(B) It is necessary for the half mirror to have a function of transmitting a constant amount of the plane waves as they are. For this reason, the structure of the half mirrors is limited, and thus a degree of freedom in design is low.

(C) Since the resonator is an open type, loss caused by spatial radiation is large.

As a technique for solving the problems, the following configuration can be considered. A pair of radio-wave half mirrors are disposed opposite each other in a transmission line formed of a waveguide which propagates electromagnetic waves of millimeter waveband in a single mode (TE10 mode), and a resonator is formed between the radio-wave half mirrors. With such a configuration, the wavefront conversion is not necessary, and a filter without loss caused by spatial radiation is achieved.

However, in the structure of each radio-wave half mirror used in the filter, a slit for transmitting electromagnetic waves is provided on a metal plate with a size capable of blocking an opening of the waveguide. Because of the slit, a frequency characteristic thereof is reflected in transmittance, and the frequency characteristic deteriorates a degree of smoothness in transmittance of the entire radio-wave half mirror. Thus, when the slit is used in the filter, loss for each frequency or variation in transmittance band occurs.

In order to solve the above-mentioned problems, an object of the present invention is to provide a radio-wave half mirror for millimeter waveband capable of smoothing the frequency characteristic of the transmittance and a method of smoothing the transmittance thereof.

Means for Solving the Problems

In order to achieve the above-mentioned object, in according to a first aspect of the present invention, a radio-wave half mirror for millimeter wave band is characterized as follows.

A radio-wave half mirror for millimeter wave band is fixed inside a transmission line formed by a waveguide propagating electromagnetic waves of millimeter wave band in a single mode so as to transmit a part of incident electromagnetic waves and reflect another part thereof.

The radio-wave half mirror for millimeter wave band is characterized to include:

a half mirror body where a slit for transmitting electromagnetic waves is provided on a metal plate which has a shape blocking the transmission line; and a dielectric plate that has a predetermined thickness in a direction of propagation of the electromagnetic waves and a relative permittivity $\in_r$ of at least 3.4, has a shape blocking the transmission line, is provided on one surface side of the half mirror body so as to form a dielectric resonator which resonates at a frequency determined by the thickness and the permittivity, and has a transmittance characteristic having a degree of inclination substantially the same as that of the half mirror body in a slope which is inverse to a slope of a transmittance characteristic of the half mirror body in a desired frequency range of the millimeter wave band.

In order to achieve the above-mentioned object, according to a second aspect of the present invention, the radio-wave half mirror for millimeter wave band described according to the first aspect is characterized as follows.

The half mirror body gives a transmittance characteristic with a slope in which a transmittance decreases as a frequency increases in the desired frequency range, through the slit formed along a long side direction of the waveguide.

The dielectric plate gives a transmittance characteristic having a degree of inclination substantially the same as that of the transmittance of the half mirror body in a slope in which a transmittance increases as a frequency increases in the desired frequency range.

In order to achieve the above-mentioned object, according to a third aspect of the present invention, a method of smoothing a transmittance of a radio-wave half mirror for millimeter wave band is characterized as follows.

The method is a method of smoothing a transmittance of a radio-wave half mirror for millimeter wave band that is fixed inside a transmission line formed by a waveguide propagating electromagnetic waves of millimeter wave band in a single mode.

On one surface side of a half mirror body where a slit for transmitting electromagnetic waves is provided on a metal plate which has a shape blocking the transmission line, there is provided a dielectric plate that has a predetermined thickness in a direction of propagation of the electromagnetic waves and a relative permittivity $\in_r$ of at least 3.4, and has a shape blocking the transmission line so as to form a dielectric resonator which resonates at a frequency determined by the thickness and the permittivity.

A slope of a transmittance characteristic of the half mirror body in a desired frequency range of the millimeter wave band is inverse to a slope of a transmittance characteristic of the dielectric plate, and overall transmittance characteristics are smoothed by selecting the thickness and the permittivity of the dielectric plate such that degrees of inclination thereof are substantially the same.

Advantage of the Invention

As described above, in the present invention, the dielectric plate is disposed on one surface side of the half mirror body, and the dielectric resonator is formed, the slope of the transmittance characteristic of the half mirror body is inverse to the slope of the transmittance characteristic of the dielectric plate, and the degrees of inclination thereof are set to be the same. Hence, the overall transmittance characteristics of the radio-wave half mirror for millimeter waveband are smoothed in the desired frequency range of the millimeter waveband, and thus it is possible to obtain a uniform transmittance characteristic in a wide frequency range of the millimeter waveband. Consequently, the resonator is appropriate for various circuits including the filter.

BEST MODE FOR CARRYING OUT THE INVENTION

Hereinafter, embodiments of the present invention will be described with reference to the accompanying drawings.

Figure 1:
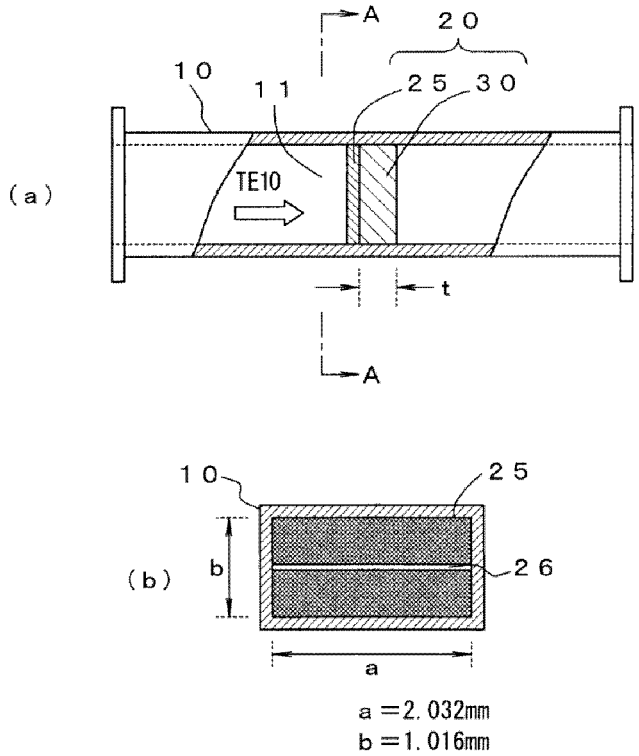
FIG. 1 is a diagram of a basic configuration of an embodiment of the present invention.

FIG. 1 shows a structure of a radio-wave half mirror for millimeter waveband (hereinafter referred to as a radio-wave half mirror) 20 according to the present invention, where FIG. 1(*a*) is a side view and FIG. 1(*b*) is a cross-sectional view taken along the line A-A.

The radio-wave half mirror 20 is fixed to block the transmission line 11 formed in the rectangular waveguide 10 with the internal diameter (a×b=2.032 mm×1.016 mm) capable of propagating electromagnetic waves in a single mode (TE10 mode) in the millimeter waveband (for example F band).

The radio-wave half mirror 20 includes a half mirror body 25 and a dielectric plate 30. The half mirror body 25 has a structure in which a slit 26 for transmitting electromagnetic waves is provided in a rectangular metal plate having a predetermined thickness (for example, 10 μm) and the same shape as the internal diameter of the waveguide 10 and inserted in the waveguide 10. Here, for example as shown in FIG. 1(*b*), the slit 26 is formed with a width of 10 μm across the center of the half mirror body 25 along the long side of the opening of the waveguide 10. In practice, the half mirror body 25 is formed by performing the etching process (or metal evaporation) on a metal layer which is provided in advance with a thickness of 10 μm on the surface of the dielectric plate 30, and is thus supported by the surface of the dielectric plate 30.

The dielectric plate 30 has a predetermined thickness t and a predetermined permittivity (relative permittivity) ∈r, has the same shape as the half mirror body 25, and is disposed in tight contact with the one surface side thereof.

As described above, when the dielectric plate 30 is disposed inside the transmission line 11, breakpoints in permittivity occur on both end faces of the dielectric plate 30, the radio waves are reflected at the points, and resonance phenomenon occurs at the frequency determined when the electrical length between the end surfaces of the dielectric plate 30 is a half wavelength (dielectric resonator). The resonant frequency depends on the thickness t and the permittivity ∈r of the dielectric plate 30, and the resonance characteristic and the transmission characteristic of the half mirror body 25 are combined into the total transmittance characteristics. Hence, through the appropriate combination of both characteristics, it is possible to obtain transmittance characteristics which are smooth in the whole range.

Figure 2:
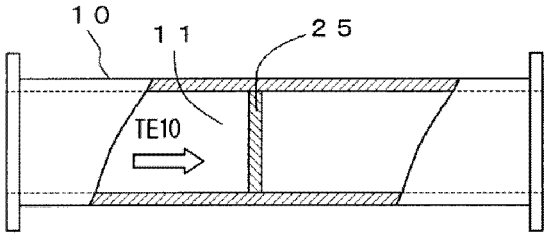
FIG. 2 is a diagram of a structure in which only a half mirror body is disposed in the transmission line.
Figure 3:
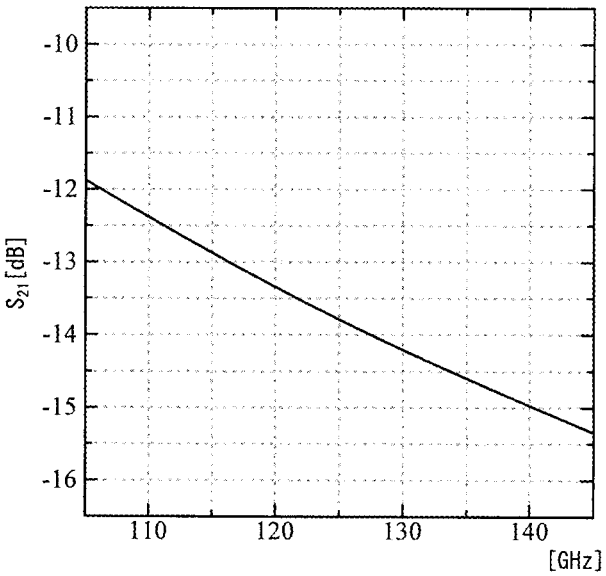
FIG. 3 is a diagram of transmittance characteristic of the structure of FIG. 2.

Next, a result of simulation on characteristics of the radio-wave half mirror 20 with the structure will be described. First, FIG. 3 shows a transmittance characteristic of the structure in which only the half mirror body 25 is disposed in the transmission line 11 as shown in FIG. 2. The transmittance characteristic deteriorates as the frequency increases at a substantially constant slope in the range of 110 GHz to 140 GHz. The reason is that the slit 26, which extends in the long side direction of the waveguide, is equivalent to a grounded capacitor circuit and deteriorates the high-frequency component thereof (low-pass characteristic). Consequently, only by using the half mirror body 25, it can hardly be expected to obtain a transmittance characteristic which is smooth in the desired frequency range (110 GHz to 140 GHz).

Figure 4:
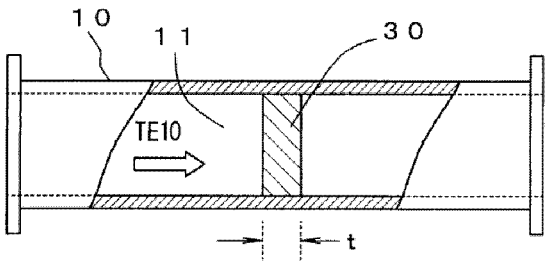
FIG. 4 is a diagram of a structure in which only a dielectric plate is disposed in the transmission line.
Figure 5:
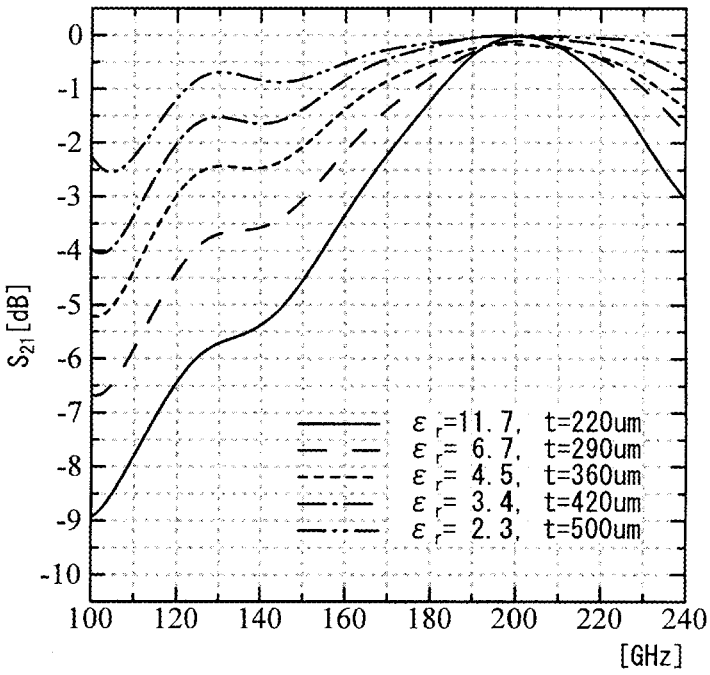
FIG. 5 is a diagram of transmittance characteristic of the structure of FIG. 4.
Figure 6:
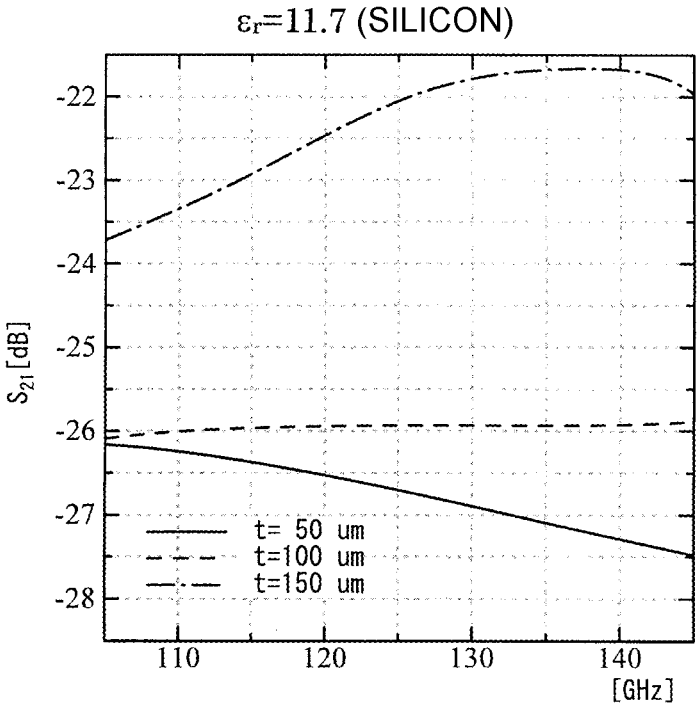
FIG. 6 is a diagram of overall transmittance characteristics in a case where the dielectric plate is silicon.
Figure 7:
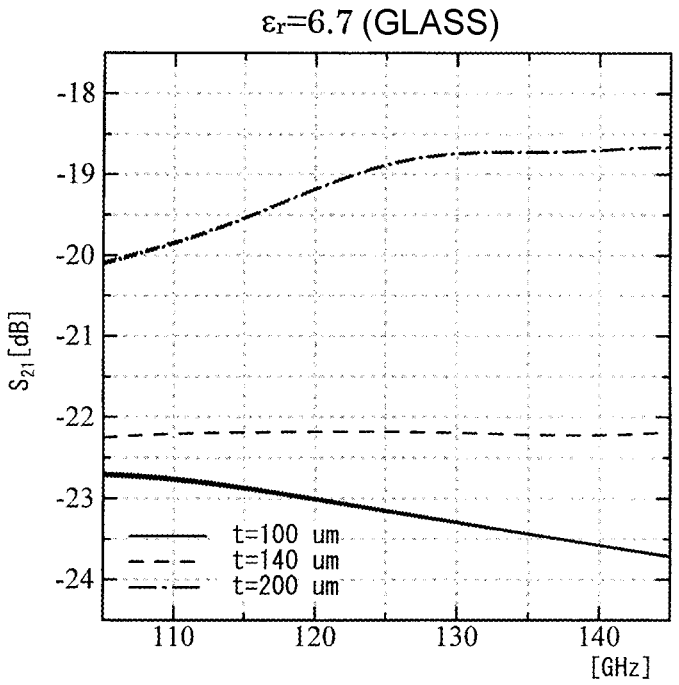
FIG. 7 is a diagram of overall transmittance characteristics in a case where the dielectric plate is glass.
Figure 8:
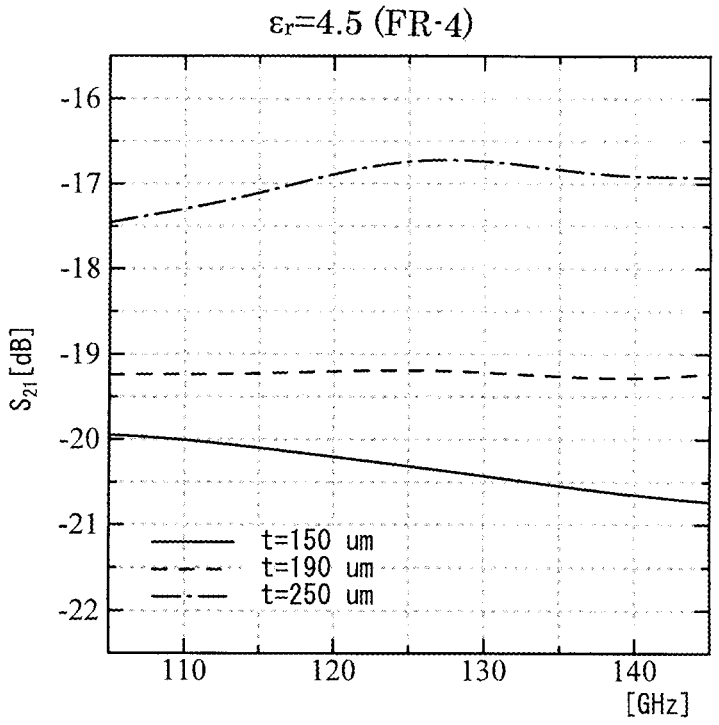
FIG. 8 is a diagram of overall transmittance characteristics in a case where the dielectric plate is FR-4.
Figure 9:
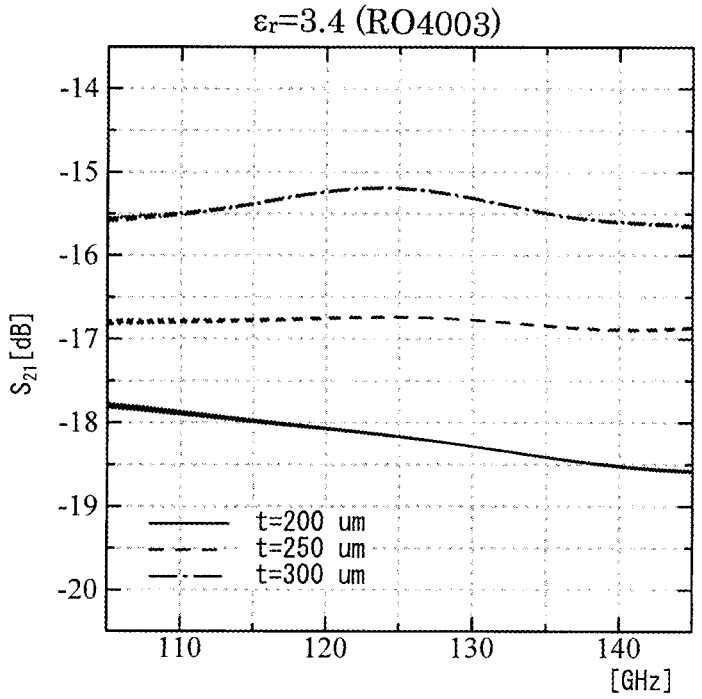
FIG. 9 is a diagram of overall transmittance characteristics in a case where the dielectric plate is RO4003.

Next, FIG. 5 shows a transmittance characteristic of the structure in which only the dielectric plate 30 is disposed in the transmission line 11 as shown in FIG. 4. Here, the used material (permittivity) of the dielectric plate 30 includes five materials of silicon (∈r=11.7), glass (∈r=6.7), glass epoxy FR-4 (∈r=4.5), RO4003 (∈r=3.4), and Teflon (registered trademark) (∈r=2.3), and the thickness t of each material is selected such that the resonant frequency is 200 GHz.

In such a transmittance characteristic of each dielectric material, the characteristic in the desired frequency range of 110 GHz to 140 GHz has a slope that increases as the frequency increases. Further, a degree of the slope slightly fluctuates but tends to be smoothly changed, and as the permittivity becomes larger, the frequency band becomes narrower, and the absolute amount of the transmittance tends to become lower. Such a transmittance characteristic of the dielectric material is horizontally shifted by changing the set value of the resonant frequency. Therefore, by selecting a material and a thickness thereof, it is possible to set the characteristic of the desired frequency range with a high degree of freedom. In addition, by combining this characteristic with the characteristic of FIG. 3, it is possible to achieve a smooth (or different) characteristic. Specifically, by using the dielectric plate of which one side has a metal layer and changing the thickness t of the dielectric plate, the total transmittance characteristics may be made to be approximate to the desired characteristic.

FIGS. 6 to 10 show results of the design for making the transmittance characteristic smooth in the desired frequency range of 110 GHz to 140 GHz. In the case of silicon of FIG. 6, t=100 μm, in the case of glass of FIG. 7, t=140 μm, in the case of FR-4 of FIG. 8, t=190 μm, and in the case of RO4003 of FIG. 9, t=250 μm. From these results, it can be seen that the frequency characteristic of transmittance can be smoothed to a tolerance of about ±0.1 dB.

Figure 10:
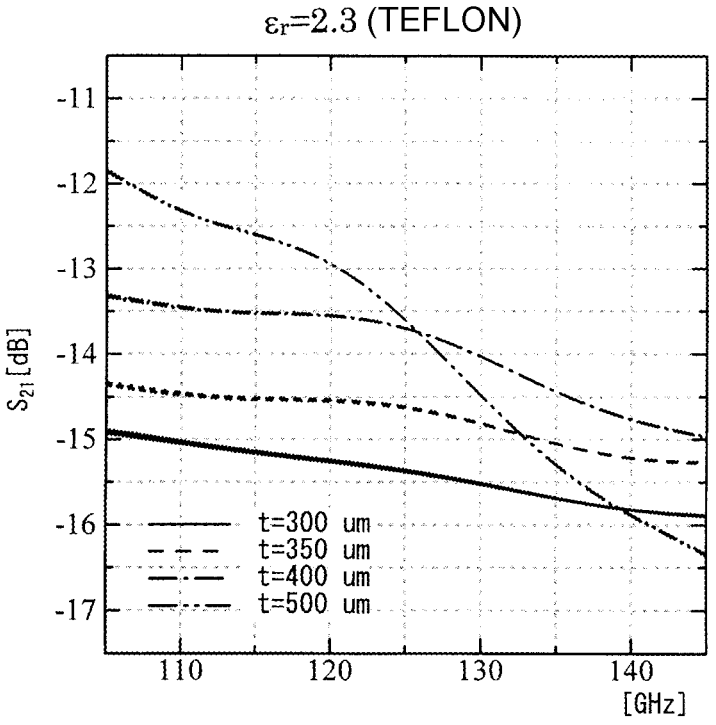
FIG. 10 is a diagram of overall transmittance characteristics in a case where the dielectric plate is Teflon (registered trademark).

Further, in the case of Teflon (registered trademark) of FIG. 10, even by adjusting the thickness of the dielectric plate 30, it is difficult to obtain a smooth characteristic. From the characteristics of FIG. 5, it can be inferred that the reason is that, if the permittivity is low, the slope of the transmittance is gentle and it is difficult to sufficiently eliminate the downward-sloping characteristic of the half mirror body 25. For this reason, when the invention is limited to the above-mentioned structure including the slit of the half mirror body 25, in order to achieve overall smooth transmittance characteristics, it is necessary to employ the dielectric plate with a permittivity ∈r of 3.4 or more.

However, the shape, the number, or the direction of the slit provided on the half mirror body 25 changes the transmittance characteristic (particularly the slope) of the half mirror body 25. Therefore, it is preferable to select the permittivity and the thickness of the dielectric plate 30 in accordance therewith, and the characteristic is likely to be smoothed even when the permittivity ∈r is less than 3.4.

In addition, here, one slit 26 along the long side direction of the waveguide is provided on the half mirror body 25. However when the slit is provided in the short side direction of the waveguide, a grounded inductance circuit is equivalently formed, and has a characteristic (high-pass characteristic) in which the transmittance in the low frequency band is lower than that in the high frequency band. Hence, when the transmittance is lowered as the frequency increases in the range of 100 GHz to 140 GHz by setting the resonant frequency of the resonator to for example about 60 GHz through the dielectric plate 30, the slope thereof can be made to be inverse to that of the transmittance characteristic of the half mirror body 25, and it is possible to smooth the total transmittance characteristics by selecting the material or the thickness thereof in a similar manner as described above.

Figure 11:
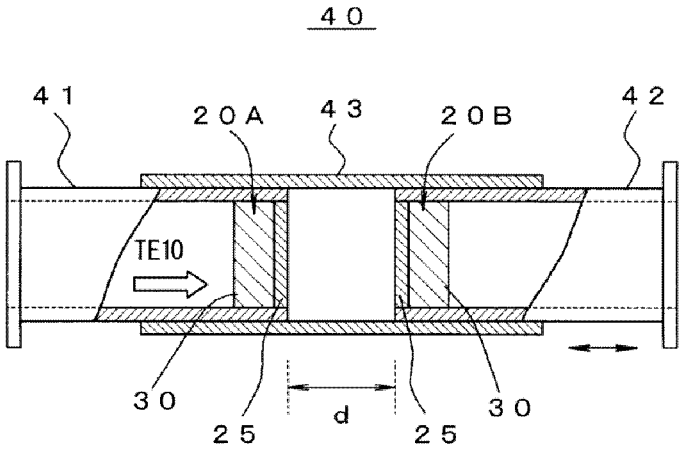
FIG. 11 is a diagram illustrating an example in which the radio-wave half mirror of the present invention is used in a filter.

FIG. 11 shows a millimeter waveband filter 40 using a structure of the radio-wave half mirror.

In the filter 40, the first waveguide 41 and the second waveguide 42, which are for the F band and have the same diameter, are disposed on the same axis such that the end faces thereof are opposed to each other, and the end portions thereof are inserted into the both ends of the third waveguide 43 with a diameter, which is slightly larger than those of the tubes, so as to be inserted therein. Thus, the three continuous waveguides 41 to 43 form a transmission line that propagates electromagnetic waves with a desired frequency range of the millimeter waveband in a single mode.

In addition, radio-wave half mirrors 20A and 20B, in which the half mirror body 25 and the dielectric plate 30 are integrated in a similar manner as described above, are mounted on the end portions of the first waveguide 41 and the second waveguide 42, and at least one of the first waveguide 41 and the second waveguide 42 is slidable in the lengthwise direction in a state where it is held by the third waveguide 43.

Consequently, the plane-type Fabry-Perot resonator is formed between the two radio-wave half mirrors 20A and 20B opposed to each other, and the space d is set to be variable. Therefore, it is possible to change the resonant frequency, and the wavefront conversion is not necessary. Accordingly, it is possible to achieve a filter which is capable of varying the frequency of the millimeter waveband with characteristics which are uniform in a wide frequency range due to the effect of the radio-wave half mirror without loss caused by external radiation.

It should be noted that, although the example of the variable frequency type filter has been described herein, the radio-wave half mirrors 20A and 20B may be fixed inside one continuous waveguide if the frequency is fixed, and the position of the radio-wave half mirror in the waveguide may be varied directly from the outside.

DESCRIPTION OF REFERENCE NUMERALS AND SIGNS

10: WAVEGUIDE
11: TRANSMISSION LINE
20, 20A, 20B: RADIO-WAVE HALF MIRROR FOR MILLIMETER WAVEBAND
25: HALF MIRROR BODY
26: SLIT
30: DIELECTRIC PLATE
40: MILLIMETER WAVEBAND FILTER
41 TO 43: WAVEGUIDE

The invention claimed is:

1. A radio-wave half mirror for a millimeter wave band that is fixed inside a transmission line formed by a rectangular waveguide propagating incident electromagnetic waves of the millimeter wave band in a single mode so as to transmit a part of the incident electromagnetic waves and reflect another part thereof, the radio-wave half mirror comprising:

a half mirror body where a slit for transmitting the incident electromagnetic waves is provided along one direction of the rectangular waveguide on a metal plate which has a shape blocking the transmission line; and a dielectric plate that has a predetermined thickness in a direction of propagation of the incident electromagnetic waves and a relative permittivity $\in_r$ of at least 3.4, has a shape blocking the transmission line, is provided on one surface side of the half mirror body so as to form a dielectric resonator which resonates at a frequency determined by the thickness and the permittivity, and has a transmittance characteristic having a degree of inclination substantially the same as that of the half mirror body in a slope which is inverse to a slope of a transmittance characteristic of the half mirror body in a desired frequency range of the millimeter wave band, wherein a transmission characteristic of the half mirror body and a resonance characteristic of the dielectric plate combine to smooth overall transmittance characteristics of the radio-wave half mirror.

2. The radio-wave half mirror for the millimeter wave band according to claim 1, wherein the one direction of the rectangular waveguide is a direction corresponding to a long side of the rectangular waveguide, wherein the half mirror body gives a transmittance characteristic with a slope in which a transmittance decreases as a frequency increases in the desired frequency range, through the slit formed along the long side direction of the rectangular waveguide, and wherein the dielectric plate gives the transmittance characteristic having the degree of inclination substantially the same as that of the transmittance of the half mirror body in a slope in which a transmittance increases as a frequency increases in the desired frequency range.

3. The radio-wave half mirror for the millimeter waveband according to claim 2, wherein the millimeter waveband is 110 GHz to 140 GHz.

4. The radio-wave half mirror for the millimeter waveband according to claim 3, wherein a value of the overall transmittance characteristics obtained by combining the half mirror body and the dielectric plate is −15 dB or less between 110 GHz and 140 GHz.

5. The radio-wave half mirror for the millimeter waveband according to claim 4, wherein the half mirror body is formed by etching the metal plate provided on the dielectric plate, or is formed by performing metal deposition on the dielectric plate.

6. The radio-wave half mirror for the millimeter waveband according to claim 3, wherein the half mirror body is formed by etching the metal plate provided on the dielectric plate, or is formed by performing metal deposition on the dielectric plate.

7. The radio-wave half mirror for the millimeter waveband according to claim 2, wherein the half mirror body is formed by etching the metal plate provided on the dielectric plate, or is formed by performing metal deposition on the dielectric plate.

8. The radio-wave half mirror for the millimeter waveband according to claim 1, wherein the millimeter waveband is 110 GHz to 140 GHz.

9. The radio-wave half mirror for the millimeter waveband according to claim 8, wherein a value of the overall transmittance characteristics obtained by combining the half mirror body and the dielectric plate is −15 dB or less between 110 GHz and 140 GHz.

10. The radio-wave half mirror for the millimeter waveband according to claim 9, wherein the half mirror body is formed by etching the metal plate provided on the dielectric plate, or is formed by performing metal deposition on the dielectric plate.

11. The radio-wave half mirror for the millimeter waveband according to claim 8, wherein the half mirror body is formed by etching the metal plate provided on the dielectric plate, or is formed by performing metal deposition on the dielectric plate.

12. The radio-wave half mirror for the millimeter waveband according to claim 1, wherein the half mirror body is formed by etching the metal plate provided on the dielectric plate, or is formed by performing metal deposition on the dielectric plate.

13. A method of smoothing a transmittance of a radio-wave half mirror for a millimeter wave band that is fixed inside a transmission line formed by a waveguide propagating electromagnetic waves of millimeter wave band in a single mode, wherein on one surface side of a half mirror body where a slit for transmitting electromagnetic waves is provided along one direction of the rectangular waveguide on a metal plate which has a shape blocking the transmission line, there is provided a dielectric plate that has a predetermined thickness in a direction of propagation of the electromagnetic waves and a relative permittivity $\in_r$ of at least 3.4, and has a shape blocking the transmission line so as to form a dielectric resonator which resonates at a frequency determined by the thickness and the permittivity, and wherein a slope of a transmittance characteristic of the half mirror body in a desired frequency range of the millimeter wave band is inverse to a slope of a transmittance characteristic of the dielectric plate, and overall transmittance characteristics of the radio-wave half mirror are smoothed by selecting the thickness and the permittivity of the dielectric plate such that degrees of inclination thereof are substantially the same.

14. The method of smoothing the transmittance of the radio-wave for the millimeter waveband according to claim 13, wherein a desired frequency range in the millimeter waveband is 110 GHz to 140 GHz.

15. The method of smoothing the transmittance of the radio-wave for the millimeter waveband according to claim 14, wherein a value of the overall transmittance characteristics obtained by combining the half mirror body and the dielectric plate is −15 dB or less in the desired frequency range in the millimeter waveband.

16. The method of smoothing the transmittance of the radio-wave for the millimeter waveband according to claim 15, wherein the half mirror body is formed by etching the metal plate provided on the dielectric plate, or is formed by performing metal deposition on the dielectric plate.

17. The method of smoothing the transmittance of the radio-wave for the millimeter waveband according to claim 14, wherein the half mirror body is formed by etching the metal plate provided on the dielectric plate, or is formed by performing metal deposition on the dielectric plate.

18. The method of smoothing the transmittance of the radio-wave for the millimeter waveband according to claim 13, wherein the half mirror body is formed by etching the metal plate provided on the dielectric plate, or is formed by performing metal deposition on the dielectric plate.

* * * * *